US005379747A

United States Patent [19]

Morris et al.

[11] Patent Number: 5,379,747

[45] Date of Patent: Jan. 10, 1995

[54] ARCHERY BOW SIGHT

[76] Inventors: Eddy D. Morris, Rte. 2, Rocky Mountain Rd., Eufala, Ala. 36072-0086; Robert L. Coker, 40 Oakwood Ln., Dadeville, Ala. 36853

[21] Appl. No.: 127,067

[22] Filed: Sep. 27, 1993

[51] Int. Cl.[6] ..... F41B 5/00

[52] U.S. Cl. ..... 124/87; 124/90; 33/265

[58] Field of Search ..... 124/87, 90, 91, 23.1, 124/24.1, 25.6, 86, 88, 1; 33/265

[56] References Cited

U.S. PATENT DOCUMENTS

| | | | |
|---|---|---|---|
| 3,199,502 | 8/1965 | Stonecipher . | |
| 3,410,644 | 11/1968 | McLendon . | |
| 3,703,770 | 11/1972 | Sofield . | |
| 3,703,771 | 11/1972 | Saunders | 124/90 X |
| 3,859,733 | 1/1975 | Chesnick . | |
| 4,011,853 | 3/1977 | Fletcher | 33/265 X |
| 4,116,194 | 9/1978 | Topel . | |
| 4,552,121 | 11/1985 | Treaster | 124/87 |
| 4,625,422 | 12/1986 | Carlson . | |
| 4,656,747 | 4/1987 | Troncoso | 124/87 X |
| 4,895,129 | 1/1990 | Hedgpeth | 124/87 |
| 4,961,264 | 10/1990 | Topel . | |
| 5,056,498 | 10/1991 | Scherz . | |
| 5,148,603 | 9/1992 | Beutler | 33/265 |
| 5,325,598 | 7/1994 | Hall et al. | 124/87 X |

*Primary Examiner*—Randolph A. Reese
*Assistant Examiner*—Harry C. Kim
*Attorney, Agent, or Firm*—Richard C. Litman

[57] ABSTRACT

An archery bow sight installable within the bow string provides a relatively large sight window in order to allow an archer to acquire a target easily, and to preclude the need for angular compensation of the sight for the angle of a drawn bow string. While the sight window is relatively large and deep, the target alignment portion along the window interior periphery provides accurate target alignment without blocking any portion of the sight window, thus making the present sight useful in both normal and low light conditions. The sight may be formed as a monolithic, unitary component, or alternatively may be formed as separate upper and lower components with left and right strands of the bow string serving as the sides of the sight window. The sight also provides for alignment to preclude twisting due to the tension of the drawn bow string, as well as providing for securing the sight longitudinally within the string in order to prevent slippage and resulting elevational misalignment of aim.

18 Claims, 3 Drawing Sheets

ARCHERY BOW SIGHT

FIELD OF THE INVENTION

The present invention relates generally to sights and aiming aids for weapons, and more specifically to an archery bow sight installed within the bow string of an archery long bow or compound bow, and eliminating the problems associated with the angular displacement caused by the drawing of the bow string.

BACKGROUND OF THE INVENTION

Archery has become an increasingly popular sport with the passage of time. One reason for this is due to the additional challenge of archery in both hunting and target shooting, as compared to the use of explosively powered weapons for such use. Many jurisdictions recognize the additional challenge in hunting with manually powered weapons, by providing longer hunting seasons, higher limits, and/or other considerations for archery hunters.

As a result of the challenges involved, various devices have been developed to assist the archer; e.g., various sights and aiming devices attachable to some part of the bow and/or bow string. Such string mounted sights are well known, as will be discussed below, but such devices universally result in either (1) an extremely small sight picture (as in a "peep" sight) which can make it difficult to acquire the target when aiming and which requires compensation for the angle of the drawn bow string, or (2) a sight which provides a larger sight picture, but lacks precision. An additional problem with such string mounted sights is their tendency to slip along the string from time to time, thus altering the elevational accuracy of the sight.

The need arises for a bow string mounted sight which provides a relatively large sight opening and sight picture, but which also provides a sufficiently precise aiming point so as to provide the accuracy desired. The sight may be formed as a single component with the bow string secured around the sight, or alternatively may be formed as an upper and a lower component with the bow string forming the sides of the sight window or sight picture. The sight should provide a relatively small notch for precise aiming, with the notch situated at the bottom or at some point on the inner periphery of the larger sight window, thus enabling the archer to acquire the target readily through the sight window and still aim precisely. The sight should not include additional internal markers which could block some portion of the view of the target, particularly when the sight is disposed immediately adjacent the eye of the archer. Finally, the sight must include means to insure the stability of the sight relative to its placement in the bow string, thus providing the required elevational accuracy.

DESCRIPTION OF THE PRIOR ART

U.S. Pat. No. 3,199,502 issued to Guy A. Stonecipher on Aug. 10, 1965 discloses a Bow String Sight Assembly And Method Of Forming A Bow String Sight. The method comprises separating a plurality of individual strands of the bow string and inserting at least one spreader therebetween. The individual vertical strands then form a sight picture for vertical alignment of the string with a target. However, no provision is made to compensate for twist in the bow string as the bow is drawn; thus, the individual strands and spreader will turn, making it impossible to align a specific strand with the target. Moreover, the gaps between strands result in imprecise aiming using such gaps, and no vertical alignment is provided. Finally, while windage or left/right sighting is provided, no elevational sighting accuracy is provided by the relatively long strands between the spreader(s).

U.S. Pat. No. 3,410,644 issued to Alvin E. McLendon on Nov. 12, 1968 discloses a Telescopic Archery Sight Wherein The Ocular Lens Is Mounted On The Bowstring. The ocular lens provides a relatively small orifice through which it is difficult to acquire the target as the string is being drawn and the lens is at some distance from the archer's eye. Moreover, it will be seen that the string mounted lens will be at some angle to the archer's line of sight when the bow and string are drawn. The target sight picture presented by the arrangement will be accurate at only one specific relative position and angle of the lens components, and the angle of the ocular lens caused by the drawing of the bow string will render the sight picture inaccurate. Also, no means is disclosed of preventing the ocular lens from twisting as the string is drawn, and further changing the angular relationship of the lens.

U.S. Pat. No. 3,703,770 issued to Howard S. Sofield on Nov. 28, 1972 discloses an Adjustable String Peep sight mounted within the bow string and having a sliding peep sight therein. While the sight is adjustable for elevation, the same problems arise as discussed above, i.e., no means is provided to prevent twist of the sight in the string as the string is drawn, the difficulty of acquiring the target through the small peep sight, particularly in low light conditions, and the lack of compensation for angular displacement of the sight as the string is drawn.

U.S. Pat. No. 3,859,733 issued to John C. Chesnick on Jan. 14, 1975 discloses an Archery Peep Sight which allows for the angularity of the drawn bow string and a sight installed thereon. However, no means is provided to prevent twist of the sight on the string as the string tension increases during the drawing of the string; thus, the device may be angularly displaced due to such string twist, and the angular displacement of the peep hole in the sight would make it difficult, if not impossible, to acquire the target through the relatively small sight hole. Moreover, the sight itself would block a view of the target as the string is drawn, until the sight is immediately adjacent the archer's sighting eye. Also, no means is disclosed to prevent the sight from slipping within the strands and along the string, and thus altering the elevational accuracy of the sight, other than "snug fitting engagement."

U.S. Pat. No. 4,116,194 issued to Kenneth D. Topel on Sep. 26, 1978 discloses a Peep Sight For Archery Bow having means allowing for the angularity of the sight in the drawn bow string, and further means precluding twisting of the sight due to tension on the string. However, the sight still provides only an extremely small sight picture, which is unusable until the sight is immediately adjacent the archer's eye, and which makes it very difficult to acquire the target as the bow string is drawn with the sight at some intermediate distance from the archer's eye. Moreover, no specific means is disclosed to preclude the longitudinal shifting of the sight along the strands of the bow string, which possibility is even greater when one considers the force vector of the alignment device along the string, as the string is drawn.

U.S. Pat. No. 4,625,422 issued to Charles W. Carlson on Dec. 2, 1986 discloses an Archery Bow Sight Mounted On The Bow String And Method Of Making Same. The device responds to the problem of bow string twist and also provides a relatively high sight window, but the window is relatively narrow in order to provide for the lateral installation of a central aiming marker therein. The marker (40) appears sufficiently large in relation to the remainder of the sight, to block a substantial portion of a target, particularly when the sight is placed immediately adjacent the eye, as is typical with such string mounted sights. Again, no means is disclosed to prevent the slippage of the sight along the strands of the string.

U.S. Pat. No. 4,961,264 issued to Kenneth D. Topel on Oct. 9, 1990 discloses a Restraint Alignment Assembly For Use With A String-Mounted Peepsight. The patent is primarily directed to an improvement in the means for preventing twist of the string mounted sight of the patentee's earlier '194 patent discussed above; additional details are also disclosed. However, the same problem still exists regarding the small sight window within the larger sight, and the requirement for the angle of the sight window to be aligned relatively precisely by the drawn bow string, due to the small size of the window. The device still does not provide for ease of target acquisition, which can be difficult, particularly in low light conditions. The disclosure apparently does not anticipate use in such low light conditions, as a visor and light shield are disclosed on the sight. Additionally, the same problem regarding means of positively securing the sight relative to the longitudinal axis of the string, recurs here.

Finally, U.S. Pat. No. 5,056,498 issued to Patrick L. Scherz on Oct. 15, 1991 discloses an Archery Bow Peep Sight in which a spreader disposed within the strands of the bow string includes a peep sight therethrough and aligned with the string axis. The spreader is angularly displaced as the string is drawn, thus allowing the archer to sight through the angularly displaced peep sight within the spreader. The spreader may be prone to slippage or shifting along the strands of the string, thus destroying elevational accuracy. Again, the device is relatively bulky and results in difficulty in the acquisition of the target by an archer using the device.

None of the above noted patents, taken either singly or in combination, are seen to disclose the specific arrangement of concepts disclosed by the present invention.

SUMMARY OF THE INVENTION

By the present invention, an improved target sight for use with manually powered weapons is disclosed.

Accordingly, one of the objects of the present invention is to provide an improved sight which is adaptable for use on long and compound archery bows.

Another of the objects of the present invention is to provide an improved sight which is installed within the bow string.

Yet another of the objects of the present invention is to provide an improved sight which provides compensation for string twist as the bow string tension is increased as the string is drawn.

Still another of the objects of the present invention is to provide an improved sight which provides a relatively large sight window, thus allowing an archer to acquire the target easily, particularly in low light conditions.

A further object of the present invention is to provide an improved sight which also provides precise and accurate target alignment by means of a specific alignment mark or notch disposed on the inner periphery of the relatively large sight window.

An additional object of the present invention is to provide an improved sight which may be monolithically formed as a single unitary component.

Another object of the present invention is to provide an improved sight which may be constructed as separate upper and lower components, with two strands of the bow string serving as the two sides of the sight window.

Still another object of the present invention is to provide an improved sight which includes means for the prevention of longitudinal slippage or shifting along the strands of the bow string, thus preserving elevational aiming accuracy.

A final object of the present invention is to provide an improved sight for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
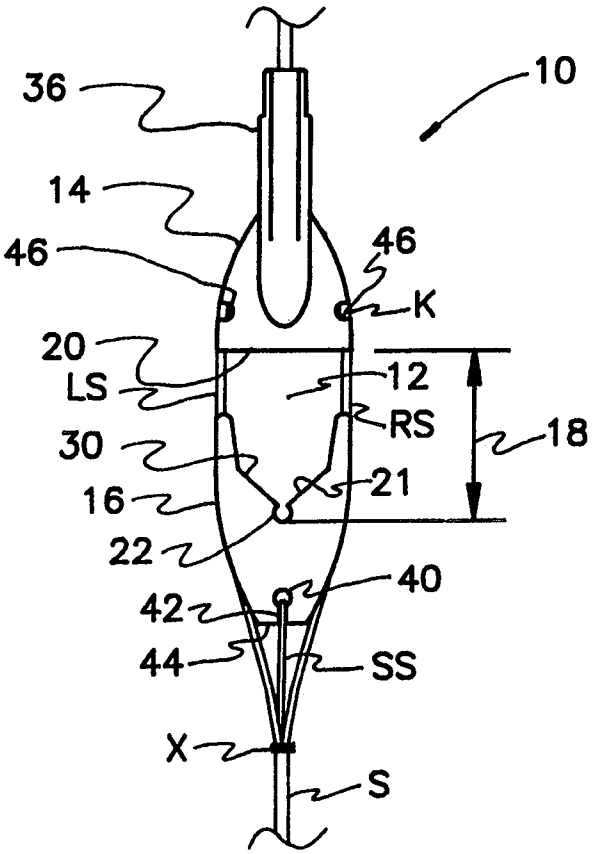
FIG. 1 is a front view of the two component embodiment of the archery bow sight of the present invention, showing its general arrangement.

Referring now particularly to FIG. 1 of the drawings, the present invention will be seen to relate to an archery bow sight 10 installable within the bow string S of a long or compound archery bow. Bow sight 10 includes a relatively large sight window 12 defined generally by an upper sight component 14, a lower sight component 16, and left and right bow string strands LS and RS. The height 18 of the sight window is defined by the separation distance between the lower edge 20 of the upper sight component 14 and the upper edge 21 of the lower sight component 16, which upper edge 21 may contain a relatively small and precise sight notch 22 and/or other relatively precise sighting means. It will be seen that the two sight components 14 and 16 may be separated within the strands LS and RS of the bow string S as desired, and fixed in place to provide a sight window 12 as desired; the means of immovably securing sight 10 of FIGS. 1, 2 and 5 and sight 10*a* of FIGS. 3 and 4 to prevent their longitudinal shifting along the bow string S will be described further below. The width of the sight window 12 is defined by the two strands LS and RS of the bow string S, which are captured by channels 24 and 26 within the opposite edges of the upper and lower sight components 14 and 16. Accordingly, the sight window 12 will be seen to have dimensions limited only by the spacing between the upper and lower sight components 14 and 16, and by the distance between the left and right bow string strands LS and RS, thus providing a relatively large sight window 12 to enable an archer to acquire a target easily, particularly in low light conditions.

Figure 6:
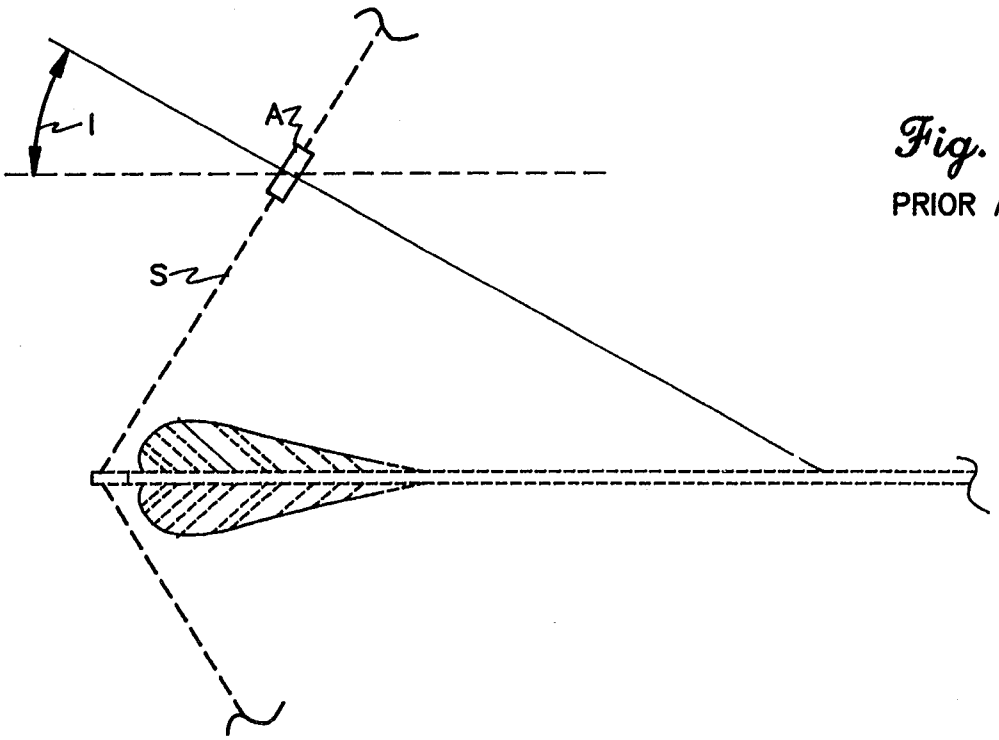
Fig. 6 PRIOR ART
FIG. 6 is a side view representing a prior art bow string sight and the sight lines and aiming problems associated therewith.
Figure 7:
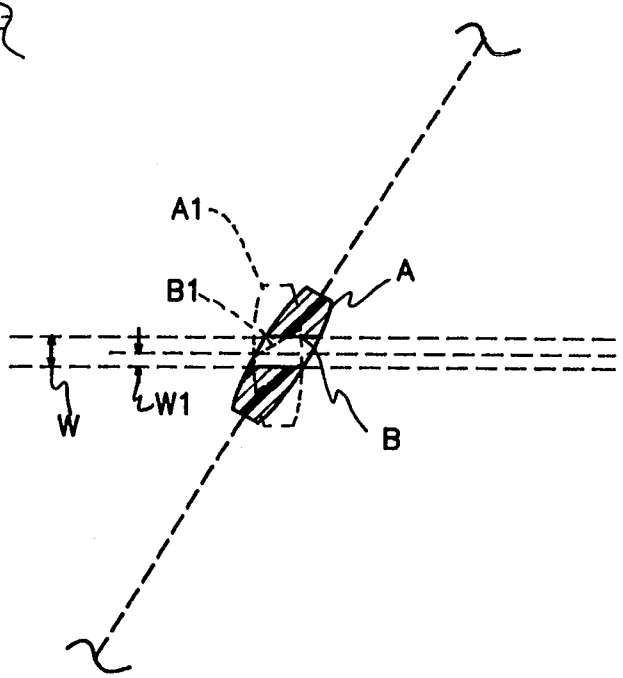
Fig. 7 PRIOR ART
FIG. 7 is a detailed side view of the prior art bow sight of FIG. 6, further illustrating the limitations thereof.

A review of the prior art of FIGS. 6 and 7 provides a comparison of the present invention to the sight windows of such prior art. FIG. 6 shows the angular displacement of such a bow string attached bow sight A as the bow string is drawn. It is known in the art to provide an angularly displaced sight passage B through such sights in order to compensate for the angular displacement of the sight as the bow string is drawn, as shown in FIG. 7, but this response to the problem creates further problems. In FIG. 7, the sight A will be seen to have an angularly displaced peep sight hole or passage B, which sight and passage are shown as they would appear with the bow string undrawn as broken lines A1 and B1. While such a relatively small sight passage B is needed for good accuracy, the angular displacement of the sight provides a relatively small sight window height W which is rendered even smaller, as at W1, when the bow string is undrawn and the sight A1 is essentially vertical. This can make acquisition of the target extremely difficult when the sight A1 is at some distance from the archer's eye, due to the small apparent window W1 and the distance from the archer's eye in combination with the overall size of the sight. Moreover, even when the string is drawn and the sight window attains its full height W, the angular displacement of the sight A precludes the sight passage B being placed immediately adjacent the archer's eye, due to the rearward angle of the lower edge of the sight. These limitations create great difficulty in acquiring a target with the eye, particularly in low light conditions, a problem which is only partially addressed by the angular inclination of a sight passage B within such a string mounted sight A.

Figure 2:
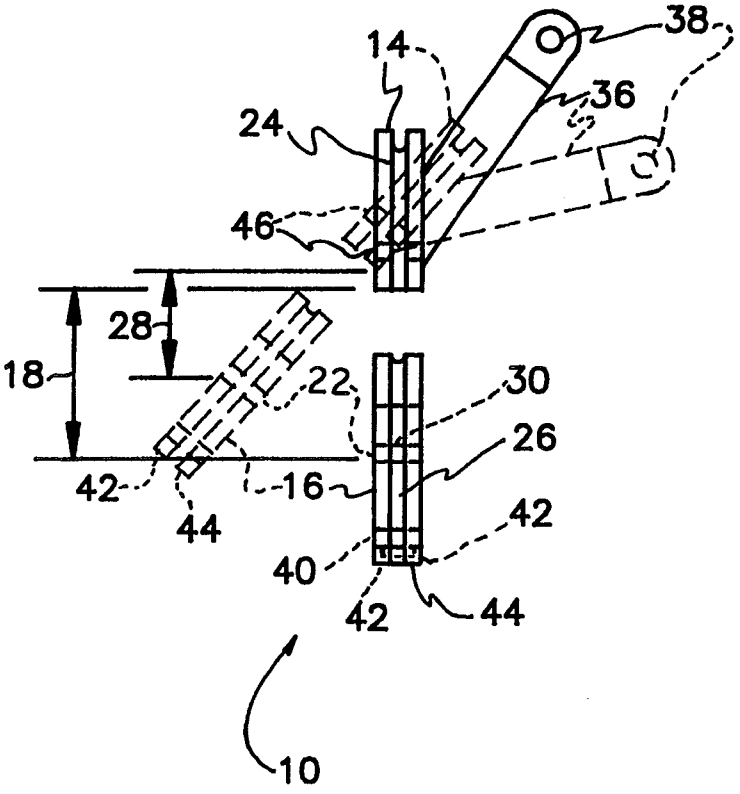
FIG. 2 is a side view of the two component sight of FIG. 1, showing the angular positioning of the sight in a bow string in both undrawn and drawn conditions.

The present invention overcomes this problem by providing a sight window 12 limited in height only by the distance between the upper and lower components 14 and 16 when installed in the string S. Moreover, the width of the sight window is defined only by the left and right strands LS and RS. The resulting construction will be seen to provide a sight window 12 whose height 18 is greater when the bow string is in an undrawn state than the height 28 of the window when the string is drawn and the sight 10 angularly displaced, and therefore the sight 10 is at a greater distance from the archer's eye, than when the string S is drawn and the sight 10 is adjacent the archer's eye; FIG. 2 provides a disclosure of this effect. This is desirable, as the apparent angular opening will increase as the sight 10 is drawn closer to the archer's eye due to the smaller distance between the sight 10 and the eye. This effect is precisely opposite that of other known prior art sights, such as the sight A of FIGS. 6 and 7.

Figure 5:
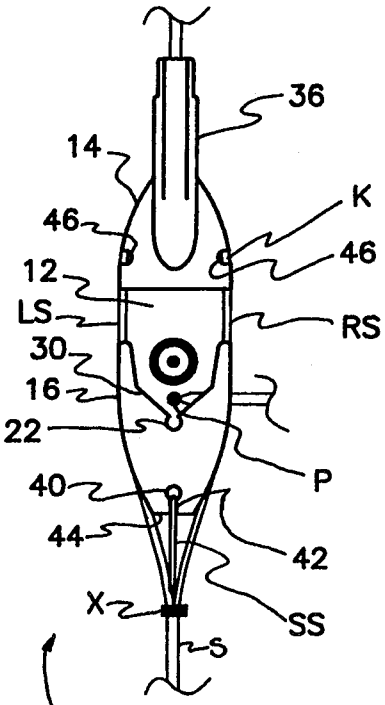
FIG. 5 is a rear view of the sight of FIGS. 1 and 2, showing the ease of acquisition of the target and also the precise aiming means provided by the sight of the present invention.

As described above, the sight window 12 of the sight 10 of the present invention provides only a general sight picture and lacks the precision provided by sights with relatively small peep sight passages, as sight A and passage B of the prior art. However, the sight 10 of the present invention also provides such precision, by means of the generally V shaped area 30 within and preferably at the bottom of the window 12 and sight notch 22 placed at the apex of the V area 30. Thus, the eye of the archer may acquire the target T and the front sight and pin P generally, through the relatively large window 12 as shown in FIG. 5, and then refine the sight picture by precisely aligning the target T, sight pin P, and sight notch 22, meanwhile being able to observe the target continually through the large sight window 12.

Figure 4:
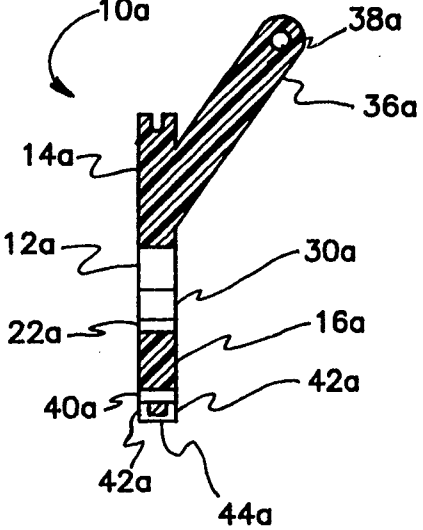
FIG. 4 is a side view in section of the bow sight embodiment of FIG. 3.
Figure 3:
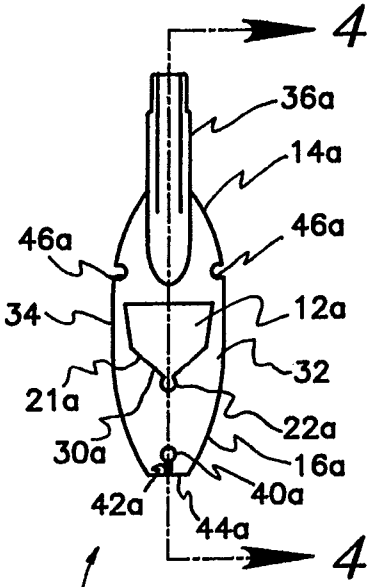
FIG. 3 is a front view of a second embodiment of the sight, showing its monolithic, unitary construction.

FIGS. 3 and 4 disclose a second embodiment of the present invention, wherein a single piece sight 10*a* of monolithic, unitary construction is disclosed. Sight 10*a* will be seen to have corresponding features to sight 10, such as a relatively large sight window 12*a*; upper and lower components 14*a* and 16*a*; and a V shaped portion 30*a* with a sight notch 22*a* at its apex. However, the upper and lower portions 14*a* and 16*a* are connected by relatively narrow left and right side members 32 and 34, which members serve the same function as the left and right bow string strands LS and RS of the first embodiment in forming left and right sides for the sight window, and further serve to connect upper and lower portions 14*a* and 16*a* of the sight 10*a* into a single piece construction. The function and operation of sight 10*a* is identical to that of sight 10.

Sights 10 and 10*a* each further respectively include alignment arms 36 and 36*a* to prevent the twisting or axial rotation of the sights 10 or 10*a* about the bow string S. Arms 36 and 36*a* respectively include passages 38 and 38*a* providing for the attachment of an elastic cord or the like (not shown) to the bow. As the bow string S is drawn rearward, the elastic cord will urge the arms 36 and 36*a* in alignment with the bow, thus precluding the axial twist of the sights 10 and 10*a* about the bow string S and keeping the sight windows 12 and 12*a* disposed generally perpendicularly to the line of sight of the archer.

An additional problem relating to sight alignment and often occurring with bow string mounted sights, is for the sight to slip longitudinally within the strands of the string, thus changing the distance between the sight and each end of the string. This has the effect of altering the vertical angle at which the bow is held to attain a given sight picture, thus reducing the elevational accuracy of the sight. The present sights 10 and 10*a* overcome this problem by means providing for the fixed securing of the sights 10 and 10*a* within and relative to the length of the bow string S. The first means for securing the lower portion of the sight 10 or 10*a* comprises a passage 40/40*a* extending through the lower portion of the sight 10/10*a* between the opposite surfaces thereof, through which a sight securing string SS is passed and secured to the bowstring S at the point X where the two strands LS and RS diverge to surround the sight 10 or 10*a*. In the case of the sight 10 having separate upper and lower components, it will be seen that the tendency will be for the lower component 16 of sight 10 to shift toward the upper component 14, thereby narrowing the height 18 of the sight window 12, due to the angular divergence of the two bow string strands LS and RS from their diverging point X and around the lower channels 26 tending to urge the lower component 16 upward. The lower portion 16 of the sight 10 cannot work downward toward the juncture X of the left and right strands LS and RS due to the pressure of those strands urging the lower portion 16 away from the juncture X. Thus, a single means for preventing such closure of the sight window 12, as by the securing string SS providing a tensile pull on the lower portion 16 of the sight 10 toward the juncture of the two strands LS and RS, is sufficient to secure the lower portion 16 of the sight 10. Additional lateral stabilization of the lower portion 16 or **16*a* of sights 10 and 10*a* is respectively provided by grooves or channels 42 and 42*a* formed generally vertically in the opposite faces of the lower portions 16 and 16*a* of sights 10 and 10*a*, between the securing passages 40 and 40*a* and continuing across the truncated lower edge 44/44*a* of the sights 10/10*a*. By passing the securing string SS through the grooves or channels 42/42*a*, the taut string SS assists in preventing lateral movement of the lower portion 16/16*a* of the sight 10/10*a*. Further protection against such lateral movement is provided by means of the truncated lower edge 44/44*a* of the lower portion 16/16*a*. By truncating the otherwise extended lower tip of the lower portion 16/16*a*, the lower portions of the left and right strands LS and RS of the bowstring S are unable to produce sufficient asymmetric leverage or pressure within the lower portions of the lower side channels 26/26*a*, to cause any degree of lateral shifting of the lower portions 16/16*a* of the sights 10/10*a***.

A second means serving to prevent the longitudinal and/or lateral shifting of the upper portion of the sight is also provided. Each upper portion **14/14*a* of sights 10/10*a* will be seen to have opposite lateral notches or reliefs 46/46*a* in the sides and across the upper channels 24/24*a*. These notches or reliefs 46/46*a* provide for the securing of the left and right bow string strands LS and RS therein, by means of knots K. Thus, the upper portions 14/14*a* of the sights 10/10*a* are precluded from shifting along the two strands LS and RS, by means of the fixed knots K being captured within the notches or reliefs 46/46*a*. The sights 10/10*a* may be further secured by extending supplemental strands (not shown) from the points where they secure to the left and right strands LS and RS at the knots K, upward along the side channels 24/24*a*** to secure to the point (not shown) at the upper juncture of the two strands LS and RS.

Accordingly, the present invention will be seen to provide an archer with easy acquisition of a target by means of a relatively large sight window 12 or **12*a*, while at the same time providing precise aiming by means of the V notch 30 or 30*a* within the window and the relatively small sight notch 22 or 22*a* at the apex thereof. The apparent field of view provided by the sight windows 12 or 12*a* narrows in height as it is angularly displaced and brought closer to the archer's eye as the string is drawn, which effect is desirable as the apparent field of view would otherwise widen as the sight 10 or 10*a* approaches the archer's eye. This effect is precisely opposite that of other string mounted peep sights, such as the prior art sight A of FIGS. 6 and 7, which sights A cause the acquisition of a target to be extremely difficult due to the distance of the sight aperture B from the archer's eye and the angularity of the sight aperture when the bow string is undrawn. This effect, in combination with the size of the sight A, can cause great difficulty for the archer attempting to visually acquire a target, particularly in low light conditions or other conditions of adverse visibility. With the present invention, the archer's eye need never leave the relatively large sight window 12 or 12*a* as the bow string S and sight 10 or 10*a* are drawn rearward toward the archer's eye. When the bow and string are properly drawn, the archer may modify the sight picture provided through the large sight window and align target, front sight, and the smaller sight notch 22 or 22*a* of the present invention for precise aiming, without even momentarily losing sight of the target by being forced to transition from a larger view outside the sight to a more precise view within the sight. The various means disclosed above for positively securing and stabilizing the sight 10 or 10*a*** within the bow string further serve to provide the accuracy required of such a device.

It is to be understood that the present invention is not limited to the sole embodiments described above, but encompasses any and all embodiments within the scope of the following claims.

We claim:

1. A bow string mounted sight for use with archery long bows and compound bows, comprising:

an upper component and a lower component each having a first surface and an opposite second surface, and left and right peripheral channels providing for the respective installation of left and right strands of a bow string, with the bow string strands providing for the securing of said bow string mounted sight within the bow string;

said upper component having a lower edge and said lower component having an upper edge, with said lower edge of said upper component and said upper edge of said lower component including a sight window therebetween and respectively defining an upper inner edge and a lower inner edge of said sight window;

said sight window comprising a first target alignment means and including a second target alignment means disposed along said lower inner edge of said sight window, with said second target alignment means being relatively smaller and more precise than said first target alignment means, whereby;

said sight window comprising said first target alignment means provides for ease of visual acquisition of a target by an archer under a variety of lighting conditions, with the archer transitioning from said first target alignment means to said relatively smaller and more precise second target alignment means as said bow string mounted sight is angularly and rearwardly displaced toward the eye of the archer due to a drawing of the bow string.

2. The bow string mounted sight of claim 1 wherein:

said bow string mounted sight is formed as a single, monolithic unit including said upper component and said lower component, with said sight window having left and right peripheries respectively defined by a left side member and a right side member extending between said upper component and said lower component.

3. The bow string mounted sight of claim 1, wherein:

said upper component and said lower component are separate members, with said sight window having left and right peripheries respectively defined by the left and right strands of the bow string.

4. The bow string mounted sight of claim 1 including:
an alignment arm extending therefrom and providing for attachment of said bow string mounted sight directly to a bow, whereby axial twist of said bow string mounted sight is prevented as the bow string twists due to tension when drawn.

5. The bow string mounted sight of claim 1 wherein:
said second target alignment means disposed along said lower inner edge of said sight window comprises a generally V shape therein, with said V shape having an apex providing for precise target alignment.

6. The bow string mounted sight of claim 5 including:
a sight notch disposed at said apex of said V shape second target alignment means.

7. The bow string mounted sight of claim 1 including:
first and second means providing for a longitudinal securing of said bow string mounted sight relative to the bow string.

8. The bow string mounted sight of claim 7 wherein:
said first means providing for the longitudinal securing of said bow string mounted sight relative to the bow string comprise a bow string securing passage through said lower component of said sight and below said target alignment means of said sight window and extending from said first surface to said opposite second surface;
a truncated lower edge formed upon said lower component of said bow string mounted sight, and;
a securing channel extending from said bow string securing passage along said first surface to said truncated lower edge, thence across said truncated lower edge and across said opposite second surface to said bow string securing passage, whereby;
a lower sight securing string is installed through said bow string securing passage and within said securing channel, and tautly secured within said securing channel and between said bow string securing passage and the bow string extending therebelow, thereby precluding an upward shifting of said lower component of said bow string mounted sight relative to the bow string.

9. The bow string mounted sight of claim 7 wherein:
said second means providing for the longitudinal securing of said bow string mounted sight relative to the bow string comprise opposite left and right lateral reliefs formed in said upper component and respectively across said left and right peripheral channels, whereby;
said opposite left and right lateral reliefs provide for a knotted securing of the left and right strands of the bow string therewithin, thereby precluding a movement of said upper component of said bow string mounted sight relative to the bow string.

10. In combination with an archery bow string, a bow string mounted sight for use with archery long bows and compound bows, comprising:
an upper component and a lower component each having a first surface and an opposite second surface, and left and right peripheral channels;
said bow string divided into separate left and right strands and providing a space therebetween, with said bow string mounted sight captured between said left and right strands of said bow string by means of said left and right peripheral channels;
said upper component having a lower edge and said lower component having an upper edge, with said lower edge of said upper component and said upper edge of said lower component including a sight window therebetween and respectively defining an upper inner edge and a lower inner edge of said sight window;
said sight window comprising a first target alignment means and including a second target alignment means disposed along said lower inner edge of said sight window, with said second target alignment means being relatively smaller and more precise than said first target alignment means, whereby;
said sight window comprising said first target alignment means provides for ease of visual acquisition of a target by an archer under a variety of lighting conditions, with the archer transitioning from said first target alignment means to said relatively smaller and more precise second target alignment means as said bow string mounted sight is angularly and rearwardly displaced due to a drawing of said bow string.

11. The bow string mounted sight of claim 10 wherein:
said sight is formed as a single, monolithic and unitary component including said upper component and said lower component, with said sight window having left and right peripheries respectively defined by a left side member and a right side member extending between said upper component and said lower component.

12. The bow string mounted sight of claim 10, wherein:
said upper component and said lower component are separate members, with said sight window having left and right peripheries respectively defined by said left and said right strand of said bow string.

13. The bow string mounted sight of claim 10 including:
an alignment arm extending therefrom and providing for attachment of said bow string mounted sight directly to a bow, whereby axial twist of said bow string mounted sight is prevented as said bow string twists due to tension when drawn.

14. The bow string mounted sight of claim 10 wherein:
said second target alignment means disposed along said lower inner edge of said sight window comprises a generally V shape therein, with said V shape having an apex providing for precise target alignment.

15. The bow string mounted sight of claim 14 including:
a sight notch disposed at said apex of said V shape second target alignment means.

16. The bow string mounted sight of claim 10 including:
first and second means providing for a longitudinal securing of said bow string mounted sight relative to said bow string.

17. The bow string mounted sight of claim 16 wherein:
said first means providing for the longitudinal securing of said bow string mounted sight relative to said bow string comprise a bow string securing passage through said lower component of said sight and below said target alignment means of said sight window and extending from said first surface to said opposite second surface;
a truncated lower edge formed upon said lower component of said bow string mounted sight, and;

a securing channel extending from said bow string securing passage along said first surface to said truncated lower edge, thence across said truncated lower edge and across said opposite second surface to said bow string securing passage, whereby;

a lower sight securing string is installed through said bow string securing passage and within said securing channel, and tautly secured within said securing channel and between said bow string securing passage and said bow string extending therebelow, thereby precluding an upward shifting of said lower component of said bow string mounted sight relative to said bow string.

18. The bow string mounted sight of claim 16 wherein:

said second means providing for the longitudinal securing of said bow string mounted sight relative to said bow string comprise opposite left and right lateral reliefs formed in said upper component and respectively across said left and right peripheral channels, whereby;

said opposite left and right lateral reliefs provide for a knotted securing of said left and right strands of said bow string therewithin, thereby precluding a movement of said upper component of said bow string mounted sight relative to said bow string.

* * * * *